US009611755B2

(12) United States Patent
Memmen

(10) Patent No.: US 9,611,755 B2
(45) Date of Patent: Apr. 4, 2017

(54) TURBINE STATOR VANE WITH INSERT AND FLEXIBLE SEAL

(71) Applicant: Robert L Memmen, Stuart, FL (US)

(72) Inventor: Robert L Memmen, Stuart, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 273 days.

(21) Appl. No.: 14/534,489

(22) Filed: Nov. 6, 2014

(65) Prior Publication Data

US 2016/0194978 A1 Jul. 7, 2016

Related U.S. Application Data

(60) Provisional application No. 61/906,437, filed on Nov. 20, 2013.

(51) Int. Cl.

| | |
|---|---|
| ***F01D 5/18*** | (2006.01) |
| ***F01D 25/12*** | (2006.01) |
| ***F01D 9/04*** | (2006.01) |
| ***F01D 11/00*** | (2006.01) |

(52) U.S. Cl.

CPC ..... *F01D 25/12* (2013.01); *F01D 5/189* (2013.01); *F01D 9/041* (2013.01); *F01D 11/003* (2013.01); *F05D 2240/55* (2013.01); *F05D 2250/75* (2013.01); *F05D 2260/201* (2013.01); *F05D 2260/30* (2013.01)

(58) Field of Classification Search

CPC ..... F01D 9/041; F01D 25/12; F05D 2220/32; F05D 2240/123; F05D 2240/142; F05D 2240/55; F05D 2250/75; F05D 2260/201; F05D 2260/30

USPC ..... 416/96 R

See application file for complete search history.

(56) References Cited

U.S. PATENT DOCUMENTS

| | | | | |
|---|---|---|---|---|
| 8,500,405 | B1 * | 8/2013 | Jones | F01D 9/047 415/115 |
| 8,556,578 | B1 * | 10/2013 | Memmen | F01D 5/189 277/644 |
| 2011/0123351 | A1 * | 5/2011 | Hada | F01D 5/189 416/97 R |
| 2013/0052008 | A1 * | 2/2013 | Spangler | F01D 5/186 416/1 |

* cited by examiner

*Primary Examiner* — Eric Keasel
*Assistant Examiner* — Jason Mikus
(74) *Attorney, Agent, or Firm* — John Ryznic

(57) ABSTRACT

An air cooled turbine stator vane with an impingement cooling insert secured within a hollow cavity, where seal slots are formed between the cavity and the insert in which a flexible seal is located, and where the cavity and the insert includes chordwise movement bumpers and sideways movement bumpers each having a gap to allow for relative movement of the insert within the cavity from thermals while maintaining a seal between the cavity and the insert. The flexible seal is an X-shaped seal having four contact surfaces with the seal slots so that a high relative movement can occur while still maintaining a tight seal. The insert includes a number of cross-over tubes connecting return air holes on the pressure side to impingement holes on the suction side of the insert.

11 Claims, 3 Drawing Sheets

TURBINE STATOR VANE WITH INSERT AND FLEXIBLE SEAL

CROSS-REFERENCE TO RELATED APPLICATIONS

This application claims the benefit to U.S. Provisional Application 61/906,437 filed on Nov. 20, 2013 and entitled TURBINE STATOR VANE WITH INSERT AND FLEXIBLE SEAL.

GOVERNMENT LICENSE RIGHTS

None.

BACKGROUND OF THE INVENTION

Field of the Invention

The present invention relates generally to a gas turbine engine, and more specifically to a turbine stator vane with an insert and a flexible or compliant seal.

Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

Turbine stator vanes are often cooled using impingement cooling inserts because the stator vanes do not rotate and thus an insert can be used. High thermal stress occurs in first and even second stage stator vanes, and thus an insert would undergo relatively high movement within the cavity of the airfoil. A flexible seal can be used to maintain a seal even under these relatively large displacements between the insert and the airfoil. However, too much relative movement between the insert and the airfoil cavity would affect the seal performance.

BRIEF SUMMARY OF THE INVENTION

A turbine stator vane with an impingement cooling insert, with a flexible seal used to provide for a seal between the insert and the cavity of the airfoil, and where seal slots include bumper surfaces to limit a range of relative movement between the insert and the airfoil cavity so that the flexible seal continues to maintain a good seal.

In one embodiment, an airfoil includes a rib forming a forward impingement cavity and an aft impingement cavity each having an impingement cooling insert located therein. Each insert and cavity includes a forward seal slot and an aft seal slot with a flexible seal secured therein. Each seal slot includes a chordwise movement bumper and a sideways movement bumper with a gap to allow for a range of movement of the insert within the cavity while the flexible seal still maintains a seal. The flexible seal is X-shaped with four contact points on the seal slots so that a relatively large but limited movement between the insert and the cavity can occur.

Another embodiment of the present invention includes a double impingement cooling insert having a pressure side surface and a suction side surface that forms a cooling air supply cavity, and where an arrangement of cross-over tubes connect return air holes on the pressure side of the insert to impingement holes on the suction side of the insert. Cooling air supplied to the supply cavity thus flows out through pressure side impingement holes to impinge on the pressure side surface of the airfoil, then flows through return air holes that are connected to the cross-over tubes. The cross-over tubes are connected to impingement cooling holes on the suction side of the insert for impingement cooling of the suction side wall of the airfoil. With the cross-over tubes, the impingement cooling holes can be made as close together as possible depending on the diameter of the cross-over tubes.

DETAILED DESCRIPTION OF THE INVENTION

The present invention is a turbine stator vane, such as a large frame industrial engine turbine stator vane, with impingement cooling inserts secured within the airfoil and sealed using a flexible or compliant seal, where the seal slots have bumper surfaces between the insert and the airfoil inner wall that limit relative movement of the seal slots so that the flexible seal maintains an adequate seal between the two surfaces. The flexible seal used in the present invention is disclosed in U.S. Pat. No. 8,556,578 issued on Oct. 15, 2013 to Memmen et al. in which the entire patent is incorporated herein by reference. The flexible seal allows for a proper seal to be maintained between seal slots formed in the airfoil wall and the insert that will allow a large relative displacement where the prior art seals will not keep a seal. One major feature missing from the Memmen patent is structure to limit the relative movements of the seal slots for a single flexible seal. The present invention solves this problem.

Figure 1:
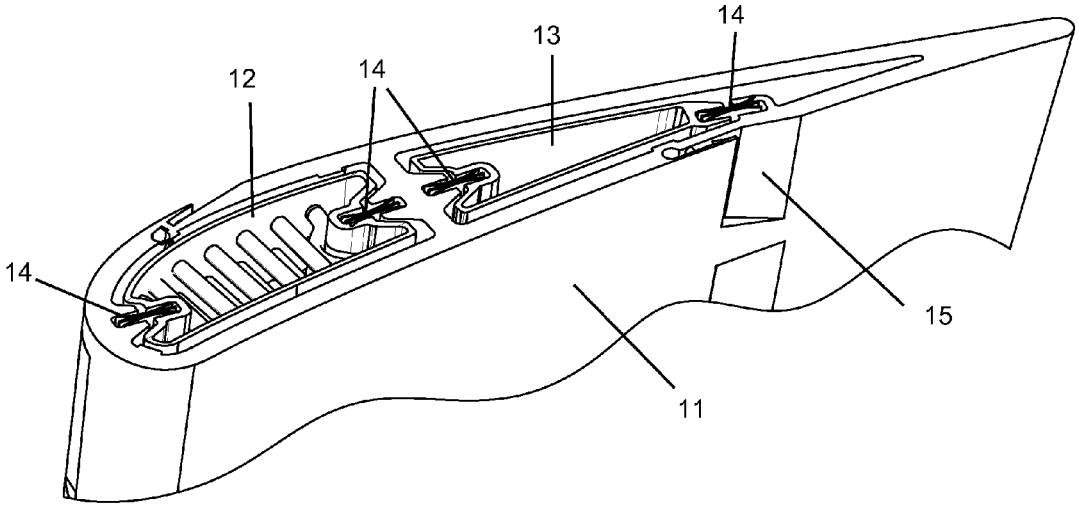
FIG. 1 shows a schematic view of a top section of a stator vane airfoil with two inserts secured inside with four flexible seals of the present invention.

FIG. 1 shows an embodiment of a stator vane with an airfoil 11 having a forward cavity with a forward impingement cooling insert 12 and an aft cavity with an aft impingement cooling insert 13. Each impingement insert produces a sequential impingement or series impingement of the airfoil walls. In this embodiment, impingement cooling occurs on the pressure side wall and then on the suction side wall. The cooling air pressure will be higher on the pressure side wall than on the suction side wall, and thus seals are required to seal the pressure side impingement cavity from the suction side impingement cavity. In one embodiment, the forward impingement cooling insert 12 includes a forward flexible seal 14 and an aft flexible seal 14. The aft impingement insert 13 also includes a forward flexible seal and an aft flexible seal 14 as seen in FIG. 1.

Figure 2:
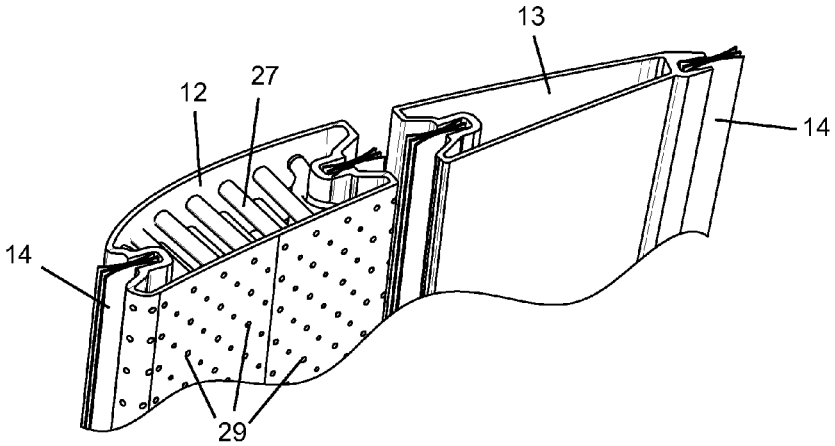
FIG. 2 shows a schematic view of a top section of a forward insert and an aft insert each with two flexible seals of the present invention.

FIG. 2 shows a top section of the forward insert 12 and the aft insert 13 with each insert having two flexible seals 14. Cross-over tubes 27 connect the pressure side impingement cavity to the suction side impingement cavity. The aft insert 13 will also include these cross-over tubes. Cooling air is supplied to the inner side of each insert and then flows out through an arrangement of impingement cooling holes 29 on the pressure side to impingement against a backside surface of the pressure side wall of the airfoil 11. The spent impingement cooling air then flows through the cross-over tubes 27 and then through impingement cooling holes to impinge on the backside surface of the suction side wall of the airfoil 11.

Use of the cross-over tubes 27 in the insert allows for a lightweight double impingement insert to be formed. Also, using the cross-over tubes 27 will allow for the impingement cooling holes on both the pressure side and the suction side of the insert to be closely spaced. This limitation in how close the impingement holes can be located will depend on the diameter of the cross-over tubes 27. The multiple impingement insert with cross-over tubes 27 can also be manufactured using one of the additive manufacturing processes such as direct metal sintering, electron beam welding, or other 3D metal printing processes to produce a one-piece insert with the cross-over tubes. The impingement holes 29 can also be formed from the metal additive manufacturing process which will further reduce cost of manufacturing because EDM drilling of the holes is quite expensive.

Figure 3:
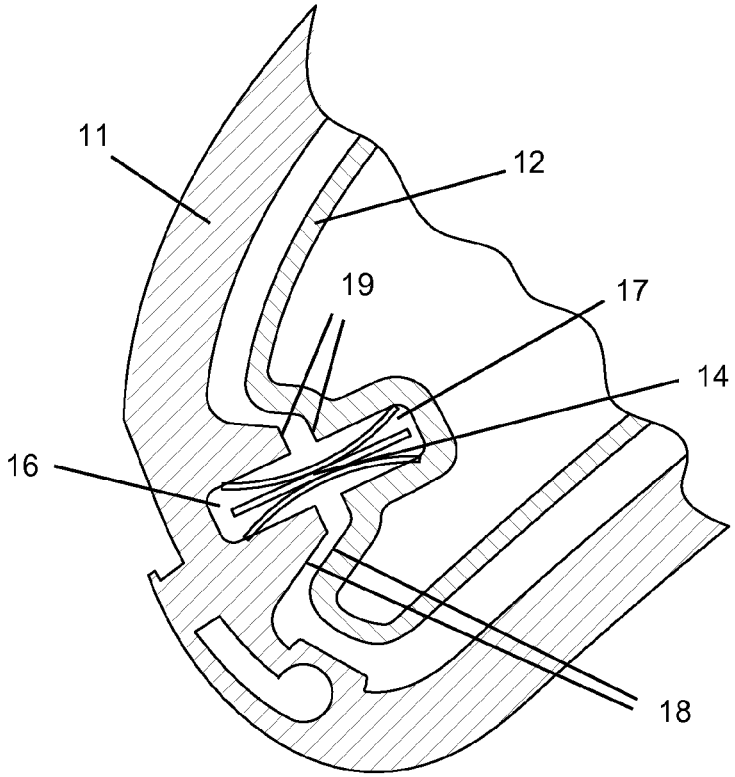
FIG. 3 shows a cross section top view of an airfoil wall and a forward insert with a flexible seal secured within slots having bumper surfaces of the present invention.

FIG. 3 shows a close-up view of the forward insert with a forward seal slot between the leading edge surface of the airfoil 11 and a forward side of the forward insert 12. A slot 16 is formed in the airfoil 11 and a slot 17 is formed in the insert 12 in which a flexible seal 14 is located. Because the cooled insert is at a much lower temperature than the airfoil during a steady state operation of the vane in an engine, the airfoil slot 16 and the insert slot 17 will have a great relative movement. Too much of a relative movement will cause the flexible seal to leak. Therefore, the present invention includes structure to limit the relative movement of the slots. In FIG. 3, two bumper surfaces 18 on the insert 12 and the airfoil 11 will limit a sideways movement, while two bumper surfaces 19 will limit a chordwise movement. Any space formed between bumper surfaces will depend on the flexibility of the seal 14.

Figure 4:
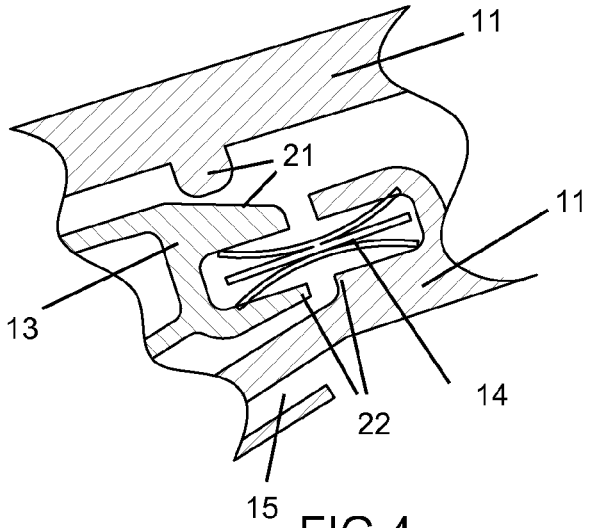
FIG. 4 shows a cross section top view of an airfoil wall and an aft insert with a flexible seal secured within slots having bumper surfaces of the present invention.

FIG. 4 shows a flexible seal 14 secured within slots between an aft side of the aft insert 13 and the airfoil 11. Bumper surfaces 21 formed on the insert 13 and the airfoil 11 will limit sideways movement while bumpers 22 will limit a chordwise movement between seal slots. In the FIG. 4 embodiment, the seal slot in the airfoil extends from a pressure side wall of the airfoil 11. A slot 15 for discharge of film cooling air is shown along the pressure side wall of the airfoil 11.

Figure 5:
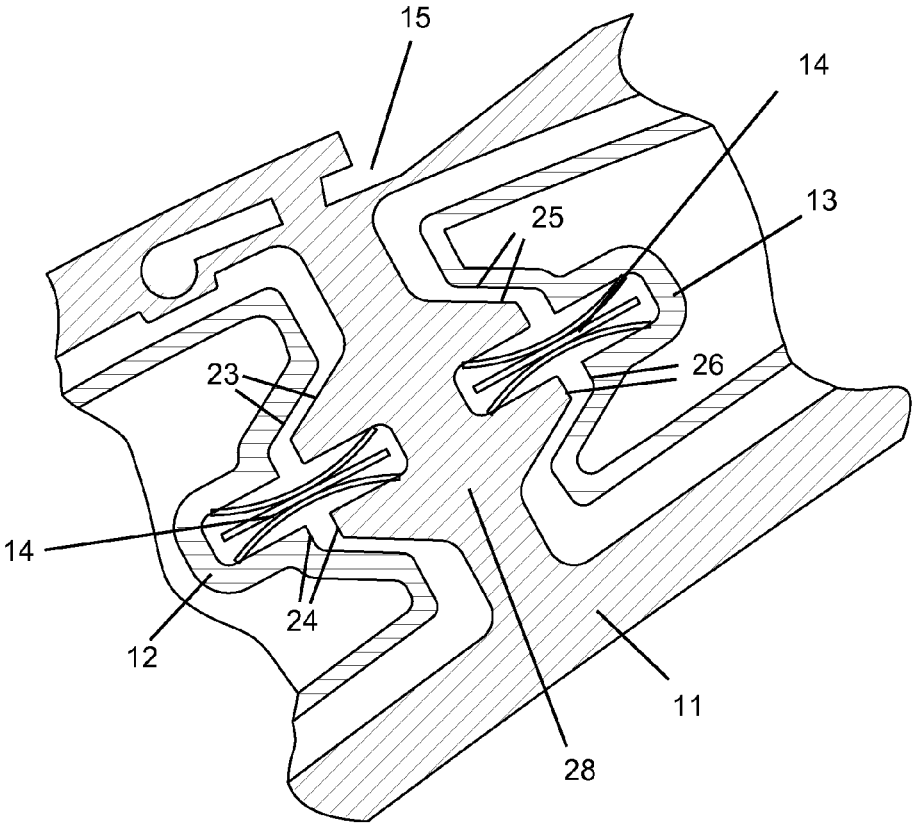
FIG. 5 shows a cross section top view of an airfoil wall with the forward insert and the aft insert secured within slots having bumper surfaces of the present invention.

FIG. 5 shows a rib 28 formed between the forward cavity and the aft cavity of the airfoil in which the forward insert 12 and the aft insert 13 are sealed with a flexible seal 14. The forward insert 12 includes bumper surfaces 23 to limit a sideways movement and bumper surfaces 24 to limit a chordwise movement. Similar structure is formed for the aft insert 13. Bumper surfaces 25 limit a sideways movement while bumper surfaces 26 limit a chordwise movement. FIG. 5 also shows a discharge slot 15 on the suction side wall of the airfoil 11. As seen in FIGS. 3 and 5, each seal slot has two sets of bumper surfaces to limit sideways movement and two sets of bumper surfaces to limit chordwise movement. In FIG. 4, two sets of bumper surfaces are formed to limit the chordwise movement. To limit the sideways movement, the suction side wall of the airfoil includes a circular shaped bumper 21 while the pressure side wall has a flat bumper surface 22 like in the other seals of the airfoil. This structure is due to the seal slots being formed upstream from the trailing edge and without a rib extending across the airfoil from the pressure side wall to the suction side wall.

The flexible seal 14 must maintain a seal between slots that have a large relative movement in order to prevent high pressure cooling air from crossing over the seal into the lower pressure cooling air and thus disrupt the series of impingement cooling from the pressure side to the suction side of the airfoil.

I claim the following:

1. An air cooled turbine stator vane comprising:

an airfoil with a leading edge region and a trailing edge region and a pressure side wall and a suction side wall;

the airfoil being a hollow airfoil forming a cavity;

a first seal slot formed on an inside section of the hollow airfoil;

an impingement cooling insert located within the cavity;

a second seal slot formed on the impingement cooling insert and facing the first seal slot;

a plurality of chordwise movement bumpers formed on the inside section of the airfoil and on the impingement cooling insert to limit a chordwise movement of the impingement cooling insert relative to the cavity;

a plurality of sideways movement bumpers formed on the inner wall of the airfoil and on the impingement cooling insert to limit a sideways movement of the impingement cooling insert relative to the cavity;

a flexible seal secured within the first and second seal slots of the cavity and the impingement cooling insert; and, a chordwise gap formed between the chordwise movement bumpers and a sideways gap formed between the sideways movement bumpers such that the flexible seal can a seal between the inside section of the hollow airfoil and the impingement cooling insert due to relative movement from thermal gradients.

2. The air cooled turbine stator vane of claim 1, and further comprising:

the hollow airfoil includes a rib separating a forward cavity from an aft cavity;

each cavity includes a forward seal slot and an aft seal slot formed between an impingement cooling insert;

each forward seal slot and aft seal slot includes a chordwise movement bumper and a sideways movement bumper;

a flexible seal secured within each of the forward seal slots and the aft seals slots; and, a gap formed between the chordwise movement bumper and a sideways movement bumper so that the flexible seals maintain a seal between the cavity and the insert due to relative movement from thermal gradients.

3. The air cooled turbine stator vane of claim 2, and further comprising:

the rib includes an aft seal slot for the forward cavity and a forward seal slot for the aft cavity.

4. The air cooled turbine stator vane of claim 1, and further comprising:

the flexible seal is an X-shaped seal with four points that each makes contact with a surface of the seal slots.

5. An air cooled turbine stator vane comprising:

an airfoil with a hollow cavity;

an impingement cooling insert secured within the hollow cavity of the airfoil;

the impingement cooling insert having a pressure side surface and a suction side surface enclosing a cooling air supply cavity;

the pressure side surface having an arrangement of pressure side impingement cooling holes connected to the cooling air supply cavity;

the pressure side surface having an arrangement of return air holes;

the suction side surface having an arrangement of suction side impingement cooling holes; and, the impingement cooling insert having a plurality of cross-over tubes that extend from a top to bottom and side to side regions of the suction side surface of the impingement cooling insert and connect the return air holes on the pressure side surface to the impingement cooling air holes on the suction side surface.

6. The air cooled turbine stator vane of claim 5, and further comprising:

the impingement cooling insert includes a forward seal slot and an aft seal slot; and, a flexible seal secured within each of the forward seal slot and the aft seal slot to produce a seal between cooling air on the pressure side and the suction side of the insert.

7. The air cooled turbine stator vane of claim 5, and further comprising:

each of the forward seal slot and the aft seal slot includes a chordwise movement bumper surface and a sideways movement bumper surface to limit a relative movement of the insert with respect to the hollow cavity of the airfoil such that the flexible seal maintains a seal.

8. The air cooled turbine stator vane of claim 6, and further comprising:

the flexible seal is an X-shaped seal having four contacts surfaces within a seal slot.

9. An air cooled turbine stator vane comprising:

an airfoil with a leading edge region and a trailing edge region and a pressure side wall and a suction side wall;

the airfoil being a hollow airfoil forming a cavity;

a first seal slot formed on an inside section of the hollow airfoil;

an impingement cooling insert located within the cavity;

a second seal slot formed on the impingement cooling insert and aligned with the first seal slot;

a plurality of bumpers formed on an inside surface of the airfoil and on the impingement cooling insert to limit a movement of the impingement cooling insert relative to the airfoil;

a flexible seal secured within the first and second seal slots of the airfoil and the impingement cooling insert; and, a gap formed between the plurality of bumpers of the airfoil and the impingement cooling insert such that the flexible seal can maintain a seal between the airfoil and the impingement cooling insert due to relative movement from thermal gradients.

10. The air cooled turbine stator vane of claim 9, and further comprising:

the flexible seal is an X-shaped seal with four points that each makes contact with a surface of the first and second seal slots.

11. The air cooled turbine stator vane of claim 9, and further comprising:

the impingement cooling insert having a pressure side surface and a suction side surface enclosing a cooling air supply cavity;

the pressure side surface having an arrangement of pressure side impingement cooling holes connected to the cooling air supply cavity;

the pressure side surface having an arrangement of return air holes;

the suction side surface having an arrangement of suction side impingement cooling holes; and, the impingement cooling insert having a plurality of cross-over tubes that connect the return air holes on the pressure side surface to the impingement cooling air holes on the suction side surface.

* * * * *